US011201406B2

(12) United States Patent
Tang et al.

(10) Patent No.: US 11,201,406 B2
(45) Date of Patent: Dec. 14, 2021

(54) SUB-REFLECTOR AND FEEDING DEVICE FOR A DIPOLE

(71) Applicant: Huawei Technologies Co., Ltd., Shenzhen (CN)

(72) Inventors: Tao Tang, Dongguan (CN); Juan Segador Alvarez, Munich (DE); Ajay Babu Guntupalli, Munich (DE); Bruno Biscontini, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/847,280

(22) Filed: Apr. 13, 2020

(65) Prior Publication Data

US 2020/0243972 A1 Jul. 30, 2020

Related U.S. Application Data

(63) Continuation of application No. PCT/EP2017/076058, filed on Oct. 12, 2017.

(51) Int. Cl.

| | |
|---|---|
| ***H01Q 21/24*** | (2006.01) |
| ***H01Q 9/28*** | (2006.01) |
| ***H01Q 19/10*** | (2006.01) |
| ***H01Q 5/40*** | (2015.01) |

(52) U.S. Cl.

CPC ..... *H01Q 5/40* (2015.01); *H01Q 9/285* (2013.01); *H01Q 19/108* (2013.01); *H01Q 21/24* (2013.01)

(58) Field of Classification Search

CPC ..... H01Q 5/40; H01Q 9/285; H01Q 19/108; H01Q 21/24; H01Q 5/48; H01Q 21/26; H01Q 1/246; H01Q 15/14; H01Q 19/10; H01Q 19/18; H01Q 19/185; H01Q 19/19; H01Q 19/193; H01Q 9/065

See application file for complete search history.

(56) References Cited

U.S. PATENT DOCUMENTS

| | | | | |
|---|---|---|---|---|
| 8,350,775 | B2 * | 1/2013 | Obermaier | H01Q 21/062 343/817 |
| 9,711,871 | B2 * | 7/2017 | Jones | H01Q 21/26 |
| 9,859,611 | B2 * | 1/2018 | Jones | H01Q 21/26 |
| 10,320,085 | B1 * | 6/2019 | Lier | H01Q 19/10 |
| 2010/0182213 | A1 | 7/2010 | Obermaier et al. | |
| 2014/0111396 | A1 * | 4/2014 | Hyjazie | H01Q 1/52 343/798 |
| 2014/0139387 | A1 | 5/2014 | Jones et al. | |

(Continued)

FOREIGN PATENT DOCUMENTS

| | | | |
|---|---|---|---|
| CN | 101080845 | A | 11/2007 |
| CN | 101479888 | A | 7/2009 |

(Continued)

*Primary Examiner* — Vibol Tan

(74) *Attorney, Agent, or Firm* — Leydig, Voit & Mayer, Ltd.

(57) ABSTRACT

An antenna element includes a reflector plate and a radiator comprising a balun device and a dipole device for operating in a first frequency band. The dipole device is connected to the reflector plate by the balun device. A distance from the dipole device to the reflector plate is more than ¼ of a wavelength at a central frequency of the first frequency band. The balun device comprises a short-circuit at a distance from the dipole device of 15 to 35 percent of said wavelength.

20 Claims, 4 Drawing Sheets

(56) References Cited

U.S. PATENT DOCUMENTS

| | | | | |
|---|---|---|---|---|
| 2015/0070234 | A1 | 3/2015 | Jones | |
| 2017/0062940 | A1 | 3/2017 | Cao | |
| 2017/0244159 | A1* | 8/2017 | Moon | H01Q 15/14 |

FOREIGN PATENT DOCUMENTS

| | | | |
|---|---|---|---|
| CN | 103181028 | A | 6/2013 |
| CN | 104685718 | A | 6/2015 |
| CN | 103098304 | B | 3/2016 |
| CN | 107210541 | A | 9/2017 |
| WO | 9959223 | A2 | 11/1999 |
| WO | 2015168845 | A1 | 11/2015 |
| WO | 2017178037 | A1 | 10/2017 |

* cited by examiner

SUB-REFLECTOR AND FEEDING DEVICE FOR A DIPOLE

CROSS-REFERENCE TO RELATED APPLICATIONS

This application is a continuation of International Application No. PCT/EP2017/076058, filed on Oct. 12, 2017, the disclosure of which is hereby incorporated by reference in its entirety.

TECHNICAL FIELD

The present invention relates to an antenna element, in particular to an antenna element suitable for use in a compact multiband antenna array. The present invention further relates to a multiband antenna suitable for multiple-input and multiple-output (MIMO) operation. The present invention also relates to a feeding device for a dipole of such an antenna element, in particular a feeding device in the form of a balun device.

BACKGROUND

Cellular mobile communication systems often need to support a variety of frequency bands which are determined by regulatory bodies. The use of multiple frequency bands requires the use of different antenna elements that are adapted to the physical characteristics of each of the frequency bands. Furthermore, when multiple frequency bands are used in one and the same base station antenna, coexistence problems emerge such as interference between the different frequency bands.

Antenna locations, in particular for cellular mobile communication systems, often are space-restricted so that the use of multiple separate antennas for the different frequency bands is usually not an option. Furthermore, site upgrades and new deployments of antenna systems face limiting regulations. Regulations in general develop slower than the technology they regulate.

With the deployment of new technologies, in particular long-term evolution (LTE) systems, antennas need to support configurations with multiple ports and/or arrays. In some configurations, support for 4×4 or even 8×8 MIMO is required. Furthermore, new frequency bands need to be supported. As the antennas for use with the new radio technologies should, if possible, fit in existing installations as much as possible, they need to be highly integrated. It is required that different frequency bands coexist within the same aperture.

SUMMARY

The present disclosure describes a concept for an improved antenna element, wherein the antenna element overcomes one or more of the above-mentioned problems of the prior art. The present disclosure further describes a concept for a multiband antenna, wherein the multiband antenna overcomes one or more of the above-mentioned problems of the prior art. Furthermore, the present disclosure describes a concept for a balun device, wherein the balun device overcomes one or more of the above-mentioned problems of the prior art.

A first aspect of the disclosure provides an antenna element comprising a reflector plate and a radiating element comprising a balun device and a dipole device for operating in a first frequency band, wherein the dipole device is connected to the reflector plate by the balun device. The distance from the dipole device to the reflector plate is more than ¼ of a wavelength at a central frequency of the first frequency band. Furthermore, the balun device comprises a short-circuit at a distance from the dipole device between 0.15 and 0.35 of said wavelength, inclusively. The antenna element further comprises a sub-reflector surrounding the radiating element and arranged between the reflector plate and the dipole device. The sub-reflector comprises a bottom section for connection to the reflector plate, a top section wider than the bottom section, and an opening through which the balun device traverses the sub-reflector.

The sub-reflector allows to symmetrize the radiation pattern of the dipole inside as it provides a symmetric environment and shields from asymmetric influences, for example from other antenna elements, in the surroundings. Lifting the dipole up to more than a quarter of a wavelength at the central frequency of the first frequency band minimizes interference with other radiating elements, in particular those for operation in a lower frequency band, and thus increases the level of transparency of the antenna element. Furthermore, decoupling with adjacent columns in an antenna array is improved. The short-circuit provided in the balun device allows to keep the electrical length of the balun device around ¼ of the wavelength, which is a preferred distance. However, the physical length of the balun, measured from the dipole device to the reflector, is more that ¼ of the wavelength.

In a further implementation of the first aspect, the sub-reflector is electrically connected to the reflector plate. This further increases the isolating effect of the sub-reflector, providing better summarization.

In a further implementation of the first aspect, the radiating element is electrically connected to the reflector plate while the sub-reflector and the radiating element are not directly electrically connected to each other.

In a further implementation of the first aspect, the top section comprises a base section and a wall section, wherein the wall section comprises a wall extending from an edge of the base section. In a further implementation of the first aspect, the base section extends in parallel to the dipole device and the wall extends from the edge in a direction from the reflector plate to the dipole device. The radiation pattern is thus further improved.

In a further implementation of the first aspect, the bottom section and the top section are connected by a tubular section comprising the opening. This is a structurally sound construction that allows for easy passage of the balun device without unnecessary added interference.

In a further implementation of the first aspect, a first dipole of the dipole device comprises a first dipole arm connected to a first balun branch of a first balun of the balun device. The first dipole further comprises a second dipole arm connected to a second balun branch of the first balun device. Between the first balun branch and the second balun branch of the first balun, there is a galvanic connection forming the short-circuit of the first balun.

In a further implementation of the first aspect, the radiating element is a dual polarized element comprising the first dipole with a first polarization and a second dipole with a second polarization orthogonal to the first polarization. The second dipole further comprises a first dipole arm connected to a first balun branch of a second balun of the balun device and the second dipole comprises a second dipole arm connected to a second balun branch of the second balun. Furthermore, there is a galvanic connection between the first balun branch and the second balun branch of the second balun forming the short-circuit of the second balun. Thus, the electrical length of the balun is reduced to improve overall performance of the antenna element.

In a further implementation of the first aspect, both the short-circuit of the first balun and the short-circuit of the second balun are arranged at said distance between 0.15 and 0.35, inclusively, of said wavelength from the dipole device. The most efficient distance is a distance that is around ¼ of the wavelength. In the range given, the balun effect is the most efficient.

In the further implementation of the first aspect, the first short-circuit and the second short-circuit are connected so that the balun branches are all connected to each other. This implementation is especially useful when the radiating element is a die cast element.

A second aspect of the disclosure provides a multiband antenna, comprising a first antenna element according to any of the preceding claims comprising a first dipole device and a different second antenna element comprising a second dipole device, wherein the second dipole device is arranged at approximately the same height as the first dipole device. This allows for an improved symmetry in the radiation pattern of the multiband antenna.

In a further implementation of the second aspect, the second antenna element is a multi-band antenna element comprising a third dipole or patch element for operating in a second frequency band and wherein the second dipole element is for operating at the same first frequency band as the first dipole element of the antenna element, wherein the second frequency band is lower than the first frequency band.

A third aspect of the disclosure provides a balun device comprising a first circuit board for feeding a first dipole of a dipole device and a second circuit board for feeding a second dipole of the dipole device, wherein a first short-circuit of the first balun is arranged on the first circuit board and the second short-circuit of the second balun is arranged on the second circuit board. The circuit boards comprise slots for inserting the circuit boards in each other. A first slot of the first circuit board is arranged in a closed manner within the circuit board and a second slot of the second circuit board is arranged in an open manner.

In a further implementation of the third aspect, approximate ends of the first slot and the second slot are approximately at the same distance from an attachment portion for the dipole device.

In a further implementation of the third aspect, the first short-circuit and the second short-circuit are arranged at said respective approximate ends of the first slot and second slot.

In a further implementation of the third aspect, the first slot is arranged within the circuit board between the first short-circuit and the attachment portion for the dipole device. The first slot thus can securely hold the second dipole device.

The terms "horizontal", "vertical", "above", "top" and "bottom" as used in this document are intended only to describe the relative position of the elements to each other. However, these terms are not intended to describe the orientation of any dual band antenna element with respect to the Earth's surface. The dual band antenna element may be oriented in any position with respect to the Earth's surface.

These and other aspects of the disclosure will be apparent from the embodiment(s) described below.

BRIEF DESCRIPTION OF THE DRAWINGS

To illustrate the technical features of embodiments of the present disclosure more clearly, the accompanying drawings provided for describing the embodiments are introduced briefly in the following. The accompanying drawings in the following description are merely some embodiments of the present disclosure, but modifications of these embodiments are possible without departing from the scope of the present invention as defined in the claims.

DETAILED DESCRIPTION

Figure 1:
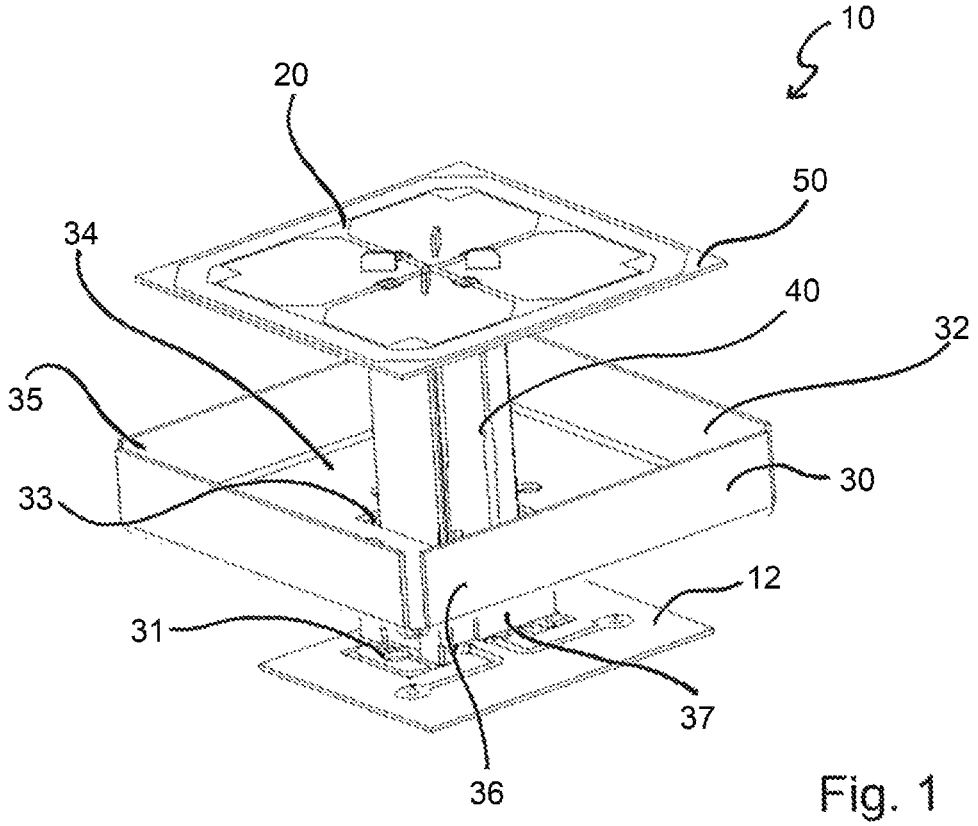
FIG. 1 shows a perspective view of an antenna element according to an embodiment.

An antenna element 10 according to an embodiment is shown in FIG. 1. The antenna element 10 comprises a radiating element 20 and a sub-reflector 30. The antenna element 10 may also comprise or at least be connected to a reflector plate which is not shown in FIG. 1.

The radiating element 20 comprises a balun device 40 and a dipole device 50. The dipole device 50 is substantially flat and the balun device 40 is mounted on the dipole device 50 in a generally perpendicular fashion. The balun device 40, and thus the radiating element 20, is connected to the reflector plate via a feeding board 12.

The sub-reflector 30 comprises a bottom section 31 for connection, in particular for electrical connection, to the reflector plate. The electrical connection to the reflector plate may be for example galvanic or capacitive. The sub-reflector 30 further comprises a top section 32 which is wider than the bottom section. An opening 33 is provided for the balun device 40 to traverse the sub-reflector 30. The top section 32 may, for example, comprise a base section 34 which may be flat and may for example be arranged in parallel to the dipole device 50. Furthermore, the top section 32 may comprise a wall section 35 running along an outer edge of the base section 34 and comprising a wall 36 extending from the edge, for example in a direction from the reflector plate to the dipole device 50. The bottom section 31 and the top section 32 may for example be connected by a tubular section 37 which comprises the opening 33.

The sub-reflector 30 and the radiating element 20 are electrically not directly connected to each other. The only connection between the sub-reflector 30 and the radiating element 20 goes through the reflector plate. E.g. both the sub-reflector 30 and the radiating element 20 can be connected to a ground potential. However, this mutual connection to the ground potential is established through the reflector plate. The sub-reflector 30 can be made from separate metal sheets. E.g. the tubular section 37 may be made from a first metal sheet and the top section 32 may be made from a second metal sheet in electrical contact with the tubular section 37.

Figure 2:
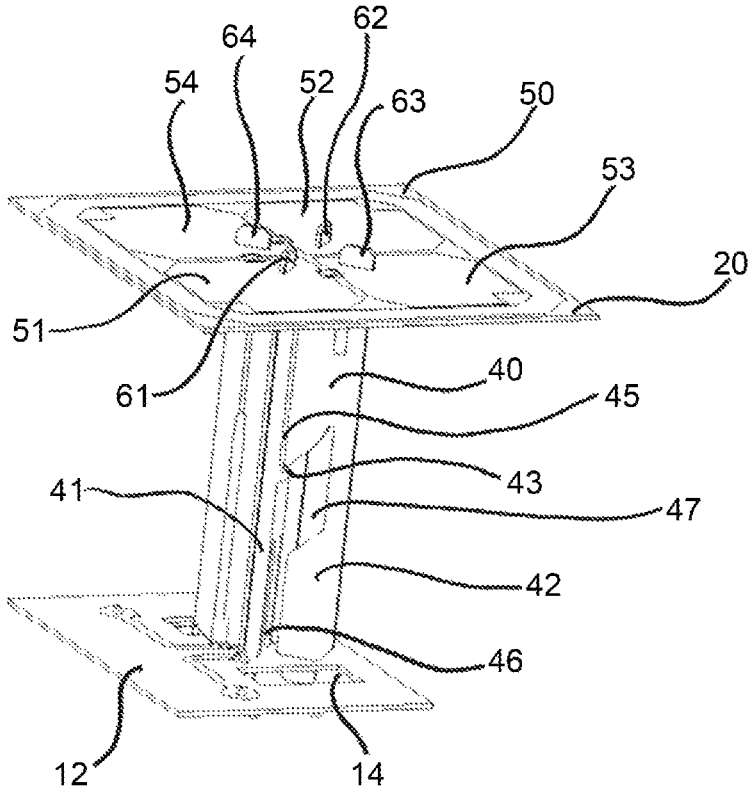
FIG. 2 shows a perspective view of the antenna element according to FIG. 1 without the sub-reflector.

In FIG. 2, the radiating element 20 and the feeding board 12 are shown without the sub-reflector 30. The dipole device 50 comprises dipole arms 51, 52, 53, 54 which are, for example, arranged in regular 90° intervals around a common center. Two of the dipole arms 51, 52, 53, 54 each may form a dipole. For example, a first dipole comprises the two opposing dipole arms 51, 52 and a second dipole comprises the two opposing dipole arms 53, 54. The first dipole has a first polarization and the second dipole has a second polarization orthogonal to the first polarization.

The radiating element 20 comprises, in this embodiment, comprises printed circuit boards which carry wire traces. For example, the dipole arms 51, 52, 53, 54 are all formed by wire traces on one printed circuit board which is the basis for the dipole device 50.

The balun device 40 comprises a first balun 41 and a second balun 42. The first balun 41 comprises a short circuit 43.

A balun is an electrical device that converts a balanced signal (two signals working against each other where ground is irrelevant) in an unbalanced signal (a single signal working against ground). In the embodiments described herein in the dipole arms the signal is balanced while at the input line the signal is unbalanced.

Also the second balun 42 comprises a short-circuit but which can't be seen in FIG. 2. The first balun 41 is arranged on a first (balun) circuit board 65 which comprises slots 45, 46. The second balun 42 is arranged on a second (balun) circuit board 66 which comprises a slot 47. The second circuit board 66 is inserted into the slot 45 of the first circuit board 65. The first circuit board 65 and the second circuit board 66 thus may, for example, be arranged perpendicularly relative to each other. The feeding board 12 comprises openings 14 which allow the bottom section 31 to contact the reflector plate without a direct connection to the feeding board 12.

Figure 7:
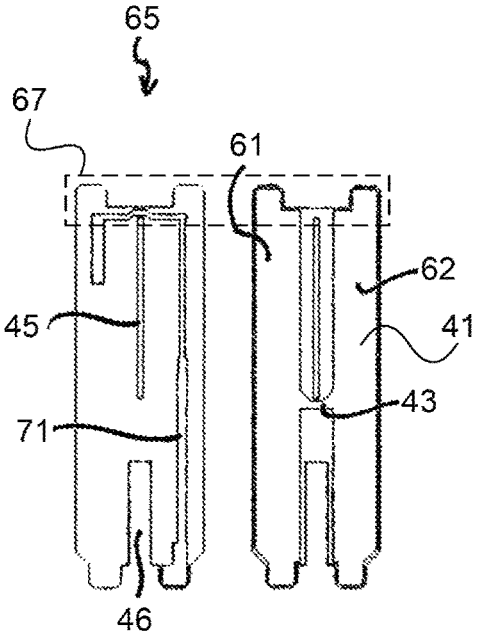
FIG. 7 shows front and back side views of a first balun of a balun device according to the embodiment of FIG. 1.
Figure 8:
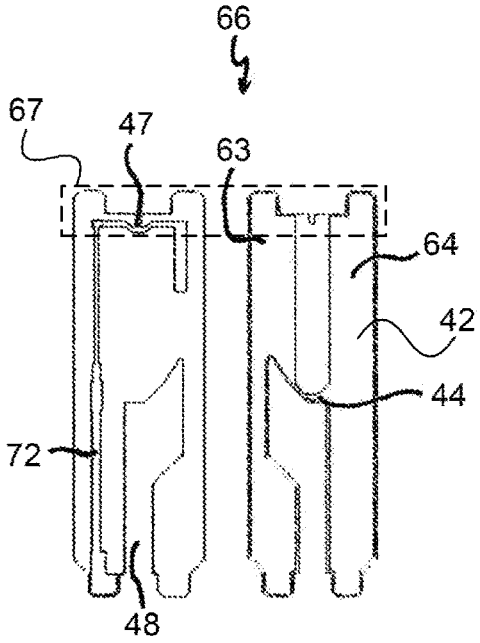
FIG. 8 shows front and back side views of a second balun of a balun device according to the embodiment of FIG. 1.

With regard to FIGS. 7 and 8, the first circuit board 65 of which the front is shown to the right and the back is shown to the left of FIG. 7, may comprise two slots 45, 46 through which a second circuit board 66 may be inserted. The first circuit board 65 carries the first balun 41 on the back as shown on the right side of FIG. 7. The second circuit board 66 of which the front is shown to the right and the back is shown to the left of FIG. 8, may comprise two slots 47, 48. The second circuit board 66 carries the second balun 42 on the back as shown on the right side of FIG. 8.

Furthermore, the first circuit board 65 carries on its front side a first transmission line 71 (in form of a wire trace) serving as feedline for the first dipole of the dipole device 50. The second circuit board 66 carries on its front side a second transmission line 72 (in form of a wire trace) serving as feedline for the second dipole of the dipole device 50.

The slot 48 gives enough room for the insertion of the second circuit board 66 into the first balun 41. The slot 47 may for example be merely a small notch for locking the second circuit board 66 within the slot 45 once the insertion is complete.

To hold the second circuit board 66, the slot 45 is arranged in a closed manner, meaning that it is, within the plane of the first circuit board 65, entirely surrounded by the material of the first circuit board 65. The second circuit board 66 can thus only be inserted or removed in a direction perpendicular of the first circuit board 65. The slot 48 of the second circuit board 66, however, is arranged in an open manner to allow the first circuit board 65 to pass into that slot 48 when the second circuit board 66 is inserted into the first circuit board 65. As the insertion process comprises a relative movement between the first circuit board 65 and the second circuit board 66, it may also be considered that the first circuit board 65 is inserted into the second circuit board 66.

Each of the circuit boards 65, 66 comprises a short circuit 43, 44 which is arranged at about the same height on back sides of the circuit boards 65, 66. The short circuit 43 of the first circuit board 65 connects a first balun branch 61 to a second balun branch 62 to form the first balun 41. The first balun branch 61, the second balun branch 62 and the short circuit 43 may be made of thin metal layers arranged on the surface of the first circuit board 65. Accordingly, the short circuit 44 of the second circuit board 66 connects a first balun branch 63 to a second balun branch 64 to form the second balun 42. The first balun branch 63, the second balun branch 64 and the short circuit 44 may also be made of thin metal layers arranged on the surface of the second circuit board 66.

The short circuit 43 and the short circuit 44 each comprise a galvanic connection between the first balun branch 61, 63 and the second balun branch 62, 64, respectively.

This positioning of the slots 45, 46, 47, 48 allows for the baluns 41, 42 to both have short-circuits 43, 44. If the slots 45, 46, 47, 48 are all open, then it may be difficult to place short-circuits 43, 44 at the required positions on both circuit boards 65, 66. In particular, the first slot 45 and the second slot 48 have proximate ends, meaning ends that are close to an end of the other slot respectively, which are arranged approximately at the same distance from an attachment portion 67 for the dipole device 50. The short-circuits 43, 44 are, for example, placed on the circuit boards 65, 66 near or at the proximate ends of the first slot 45 and the second slot 48. Also, the first slot 45 may arranged within the first circuit board 65 between the first short-circuit 43 and the attachment portion for the dipole device 50. The attachment portion 67 of the dipole device 50 is the area at the top of the circuit boards 65, 66 where the dipole device 50 is fixed e.g. soldered to the to the circuits boards 65, 66. In the embodiment shown in FIG. 7 and FIG. 8 the attachment portion has pins which can pass through corresponding openings in the circuit board carrying the dipole device 50. The pins are then soldered together with corresponding soldering pads on this circuit board for attaching the circuit boards 65, 66 to the circuit board carrying the diploe device 50.

As can be seen in FIG. 2, the first balun branch 61 may be connected (e.g. soldered) to the dipole arm 51, the second balun branch 62 may be connected (e.g. soldered) to the dipole arm 52, the first balun branch 63 may be connected (e.g. soldered) to the dipole arm 53 and the second balun branch 64 may be connected (e.g. soldered) to the dipole arm 54. A side of the balun device 40 at which the dipole arms 51, 52, 53, 54 are connected to the balun branches 61, 62, 63, 64 is a dipole side 68. An opposing side, which connects to the reflector plate, is a reflector side 69. The sub-reflector 30 will typically be arranged in a distance from the reflector plate between the reflector plate and the short-circuits. This can be nicely seen from FIG. 4 but also from FIG. 1 where the short circuits are nearer to the radiating elements than the sub-reflectors.

The slot 45 of the first circuit board 65 may for example be arranged between the short-circuit 43 and the dipole side 68. Regarding both FIG. 7 and FIG. 8, the baluns 41, 42 are each formed by printed wire traces on the circuit boards 65, 66. In particular, transmission lines, for example on the back of the circuit boards 65, 66, provide the desired balun.

Figure 9:
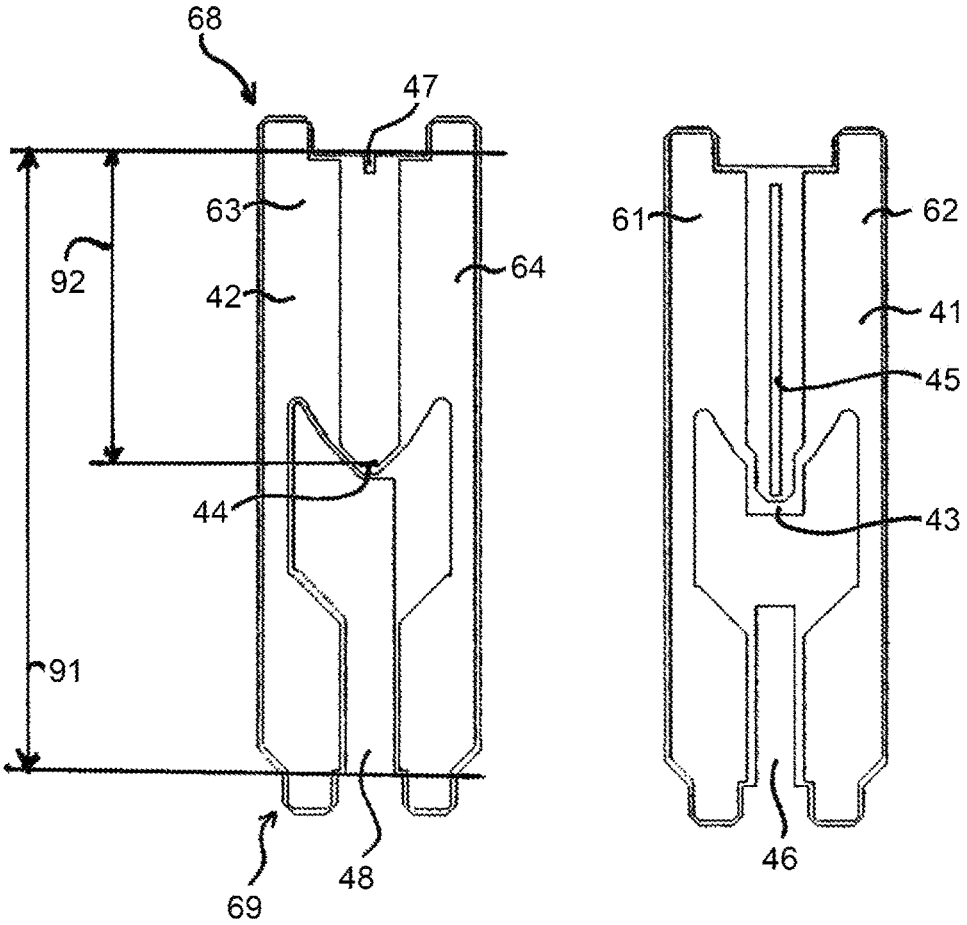
FIG. 9 shows front side views of a first balun and the second balun of a balun device according to a further embodiment.

FIG. 9 shows a slightly modified embodiment of the first circuit board 65 and the second circuit board 66 wherein the form of the metal layer that forms the balun branches 61, 62, 63, 64 and the short-circuits 43, 44 may be, for example, mostly symmetric. Furthermore, the metal layer may have a similar shape on both circuit boards 65, 66. These symmetrized metal layers reduce the effects of possible resonances.

A first distance 91 from the dipole device to the reflector plate may, for example, be more than one quarter of a wavelength at a central frequency of the first frequency band. A second distance 92 from the dipole device to any of the short-circuits 43, 44 may be between 0.15 and 0.35 of said wavelength. These values for the first distance 91 and the second distance 92 may be applicable to all the embodiments shown herein.

Figure 3:
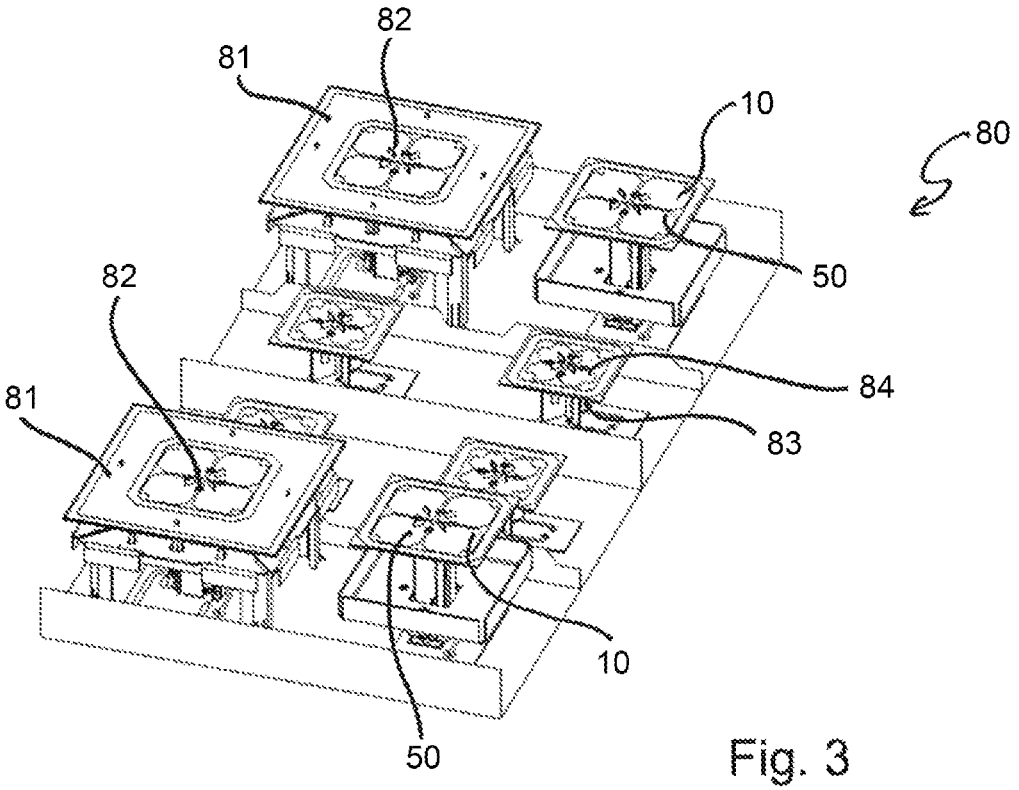
FIG. 3 shows a perspective view of a multiband antenna according to a further embodiment.

The antenna element 10 may be used in a multi band antenna 80 as shown in FIG. 3. The multiband antenna 80 comprises first antenna elements 10 as well as second antenna elements 81. The second antenna elements 81 comprise second dipole devices 82 which are arranged at approximately the same height as the (first) dipole devices 50 of the antenna elements 10. Approximately may for example mean that the second dipole devices 82 are arranged at a height that differs from the height of the first dipole devices 50 by for example at most 0.1 of a wavelength at the center frequency of the first frequency band.

Furthermore, the multi band antenna 80 may for example comprise third antenna elements 83 comprising third dipole devices 84.

The second antenna elements 81 may for example be dual band antenna elements 81 for use in a second frequency band, for example in a lower frequency band than the first frequency band. The third antenna elements 83 may, for example, operate in the first frequency band, in the second frequency band or in a third different frequency band.

The third frequency band may be higher or lower than the first frequency band and may as well be partially overlapping.

Figure 6:
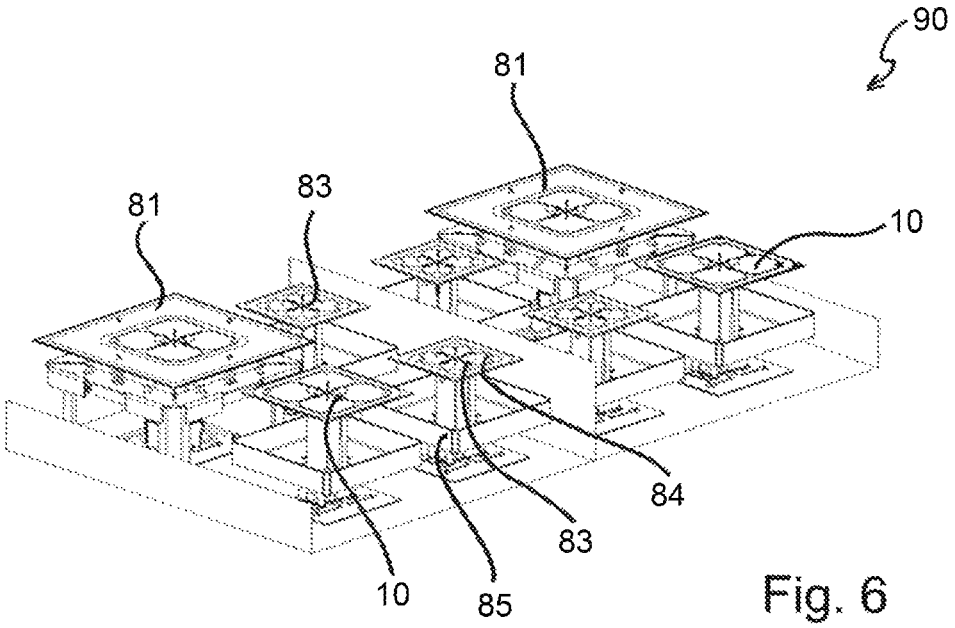
FIG. 6 shows a perspective view of a multiband antenna according to a further embodiment.

As shown in a further embodiment of a multi band antenna 90 which is shown in FIG. 6, it is also possible to lift up the third dipole devices 84 of the third antenna elements 83 to the same height as the second dipole devices 82 and the first dipole devices 50. In this case, additional sub-reflectors 85 may for example be provided for the third antenna elements 83 as well. This leads to a highly symmetrical array of dipole devices 50, 82, 84 arranged at the same height which improves the performance of the multiband antenna 90 in the first frequency band and/or third frequency band.

Figure 4:
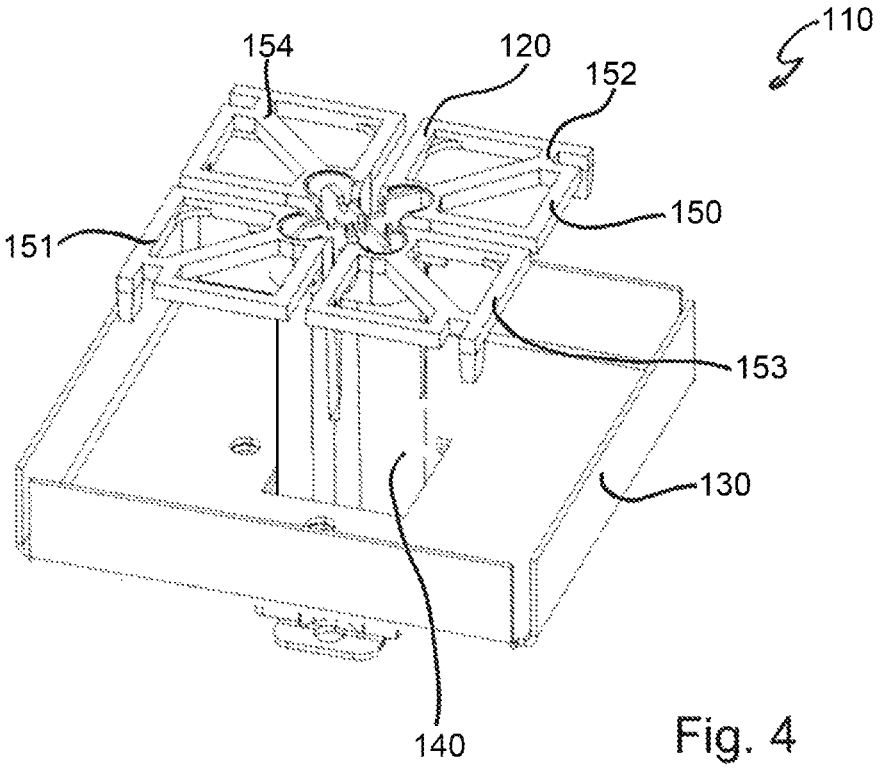
FIG. 4 shows a perspective view of an antenna element according to a further embodiment.

The further embodiment of an antenna element 110 shown in FIG. 4 follows similar construction principles so that similar features are designated with the same or like reference numerals as before. To avoid unnecessary repetition, features that have an identical or mostly identical function as before will not be described again.

The antenna element 110 comprises a radiating element 120 which in turn comprises a dipole device 150 and a balun device 140. The dipole device 150 comprises dipole arms 151, 152, 153, 154. The antenna element 110 further comprises a sub-reflector 130.

The radiating element 120 in this embodiment is manufactured by using die-cast technology, comprising all solid conducting elements that, at the same time, provide a support structure. The radiating element 20 comprises, in contrast, wire traces on circuit boards 65, 66, wherein the circuit boards 65, 66 provide the support structure.

Figure 5:
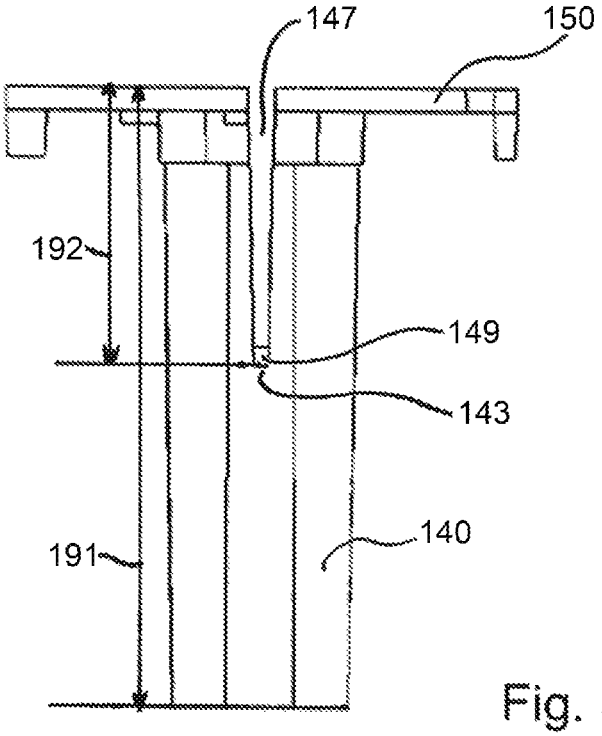
FIG. 5 shows a side view of the balun device of the antenna element according to the embodiment of FIG. 4.

FIG. 5 shows the balun device 140 which comprises a notch 147. The balun device 140 is die-cast such that the four balun branches are all electrically connected (short circuited) to each other until the tip 149 of the notch 147 forming a common short circuit 143. The notch 147, by its height 192, defines an electrical length of the balun device 140 as the short-circuit 143 is located at the tip 149, the balun branches for example being solid. The height 192 further may be between 0.15 and 0.35 of a wavelength at a center frequency of the first frequency band. A total height 191 of the radiating element 120 may, for example, be more than one quarter of a wavelength at a central frequency of the first frequency band.

While the different embodiments of antenna elements 10, 110, radiating elements 20, 120, balun devices 40, 140, baluns 41, 42 and dipole devices 50, 150 may have been disclosed herein only in certain relations to each other, it is, of course, possible for the skilled person, to combine the different embodiments in an advantageous matter. In particular, the different embodiments of baluns 41, 42 may be combined to form different balun devices 40, 140 and different balun devices 40, 140 might be used in conjunction with different dipole devices 50, 150 to form different radiating elements 20, 120.

Embodiments described herein allow the construction of compact antennas 80, 90 and antenna arrays. The antenna element 10, 110 has a symmetrized radiation pattern and is shielded from interference from surrounding antenna elements by the sub-reflector 30.

The invention has been described in conjunction with various embodiments herein. However, other variations to the disclosed embodiments can be understood and affected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The number of certain elements used in the embodiments may be changed according to the needs as determined by the skilled person, e.g. the number of radiating elements, feeding lines, dipole devices and the numbers given herein shall not be understood to delimit the invention. The mere fact that certain measures are recited in mutually different dependent claims does not indicate that the combination of these measures cannot be used to advantage. Although the present invention and its advantages have been described in detail, it should be understood that various changes, substitutions, alterations, modifications and combinations can be made herein without departing from the spirit and scope of the invention as defined by the appended claims.

What is claimed is:

1. An antenna element, comprising:

a reflector plate, a radiator comprising a balun device and a dipole device for operating in a first frequency band, the dipole device being connected to the reflector plate by the balun device, and a sub-reflector surrounding the radiator and arranged between the reflector plate and the dipole device, the sub-reflector comprising:

a bottom section connected to the reflector plate, a top section wider than the bottom section, and an opening through which the balun device traverses the sub-reflector, wherein a distance from the dipole device to the reflector plate is more than ¼ of a wavelength corresponding to a central frequency of the first frequency band, wherein the balun device comprises a short-circuit at a distance from the dipole device in a range of 15 to 35 percent of said wavelength, and wherein the top section comprises a base section and a wall section, wherein the wall section comprises a wall extending from an edge of the base section.

2. The antenna element according to claim 1, wherein the sub-reflector is electrically connected to the reflector plate.

3. The antenna element according to claim 2, wherein the radiator is electrically connected to the reflector plate, and wherein the sub-reflector and the radiator are not directly connected to each other.

4. The antenna element according to claim 1, wherein the base section extends in parallel to the dipole device, and wherein the wall extends from the edge of the base section in a direction from the reflector plate to the dipole device.

5. The antenna element according to claim 1, wherein the bottom section and the top section are connected by a tubular section comprising the opening.

6. The antenna element according to claim 1, wherein the dipole device includes a first dipole, wherein the first dipole includes a first dipole arm connected to a first balun branch of a first balun of the balun device and a second dipole arm connected to a second balun branch of the first balun, and wherein there is a galvanic connection between the first balun branch and the second balun branch of the first balun forming the short-circuit of the first balun.

7. The antenna element according to claim 6, wherein the radiator is a dual-polarized element comprising the first dipole and a second dipole, wherein the first dipole has a first polarization and the second dipole has a second polarization orthogonal to the first polarization;

wherein the second dipole comprises a first dipole arm connected to a first balun branch of a second balun of the balun device and wherein the second dipole comprises a second dipole arm connected to a second balun branch of the second balun, and wherein there is a galvanic connection between the first balun branch and the second balun branch of the second balun forming the short-circuit of the second balun.

8. The antenna element according to claim 7, wherein both the short-circuit of the first balun and the short-circuit of the second balun are arranged at the distance from the dipole device in the range of 15 to 35 percent of said wavelength.

9. The antenna element according to claim 7, wherein first short-circuit and the second short-circuit are connected so that the balun branches are all connected to each other.

10. A multiband antenna, comprising:

a first antenna element according to claim 1; and a second antenna element comprising a second dipole device, wherein the second dipole device is arranged at approximately the same height as the first dipole device.

11. The multiband antenna according to claim 10, wherein the second antenna element is a multiband antenna element comprising a third dipole or patch element for operating in a second frequency band, and wherein the second dipole element is configured to operate in the first frequency band, and wherein the second frequency band is lower than the first frequency band.

12. The antenna element according to claim 1, wherein the A balun device comprises:

a first circuit board configured to feed a first dipole of the dipole device; and a second circuit board configured to feed a second dipole of the dipole device, wherein a first short circuit of a first balun is arranged on the first circuit board and a second short circuit of a second balun is arranged on the second circuit board, wherein the first and second circuit boards comprise slots for inserting the first and second circuit boards in each other, and wherein a first slot of the first circuit board is arranged in a closed manner within the circuit board and a second slot of the second circuit board is arranged in an open manner.

13. The antenna element according to claim 12, wherein proximate ends of the first slot and the second slot are approximately at the same distance from an attachment portion for the dipole device.

14. The balun device antenna element according to claim 13, wherein the first short circuit and the second short circuit are arranged at said respective proximate ends of the first slot and second slot.

15. The antenna element according to claim 12, wherein the first slot is arranged within the circuit board between the first short-circuit and the attachment portion for the dipole device.

16. An antenna element, comprising:

a reflector plate, a radiator comprising a balun device and a dipole device for operating in a first frequency band, the dipole device being connected to the reflector plate by the balun device, and a sub-reflector surrounding the radiator and arranged between the reflector plate and the dipole device, the sub-reflector comprising:

a bottom section connected to the reflector plate, a top section wider than the bottom section, and an opening through which the balun device traverses the sub-reflector, wherein a distance from the dipole device to the reflector plate is more than ¼ of a wavelength corresponding to a central frequency of the first frequency band, wherein the balun device comprises a short-circuit at a distance from the dipole device in a range of 15 to 35 percent of said wavelength, and wherein the bottom section and the top section are connected by a tubular section comprising the opening.

17. An antenna element, comprising:

a reflector plate, a radiator comprising a balun device and a dipole device for operating in a first frequency band, the dipole device being connected to the reflector plate by the balun device, and a sub-reflector surrounding the radiator and arranged between the reflector plate and the dipole device, the sub-reflector comprising:

a bottom section connected to the reflector plate, a top section wider than the bottom section, and an opening through which the balun device traverses the sub-reflector, wherein a distance from the dipole device to the reflector plate is more than ¼ of a wavelength corresponding to a central frequency of the first frequency band, wherein the balun device comprises a short-circuit at a distance from the dipole device in a range of 15 to 35 percent of said wavelength, wherein the dipole device includes a first dipole, wherein the first dipole includes a first dipole arm connected to a first balun branch of a first balun of the balun device and a second dipole arm connected to a second balun branch of the first balun, and wherein there is a galvanic connection between the first balun branch and the second balun branch of the first balun forming the short-circuit of the first balun.

18. The antenna element according to claim 17, wherein the radiator is a dual-polarized element comprising the first dipole and a second dipole, wherein the first dipole has a first polarization and the second dipole has a second polarization orthogonal to the first polarization;

wherein the second dipole comprises a first dipole arm connected to a first balun branch of a second balun of the balun device and wherein the second dipole comprises a second dipole arm connected to a second balun branch of the second balun, and wherein there is a galvanic connection between the first balun branch and the second balun branch of the second balun forming the short-circuit of the second balun.

19. The antenna element according to claim 18, wherein both the short-circuit of the first balun and the short-circuit of the second balun are arranged at the distance from the dipole device in the range of 15 to 35 percent of said wavelength.

20. The antenna element according to claim 18, wherein first short-circuit and the second short-circuit are connected so that the balun branches are all connected to each other.

* * * * *